United States Patent [19]

Beale

[11] Patent Number: 4,888,950

[45] Date of Patent: Dec. 26, 1989

[54] MAGNETIC DRIVEN HYDRODYNAMIC LUBRICATION SYSTEM FOR FREE PISTON STIRLING ENGINE

[75] Inventor: William T. Beale, Athens, Ohio

[73] Assignee: Sunpower, Inc., Athens, Ohio

[21] Appl. No.: 371,278

[22] Filed: Jun. 26, 1989

[51] Int. Cl.[4] ..... F02G 1/04

[52] U.S. Cl. ..... 60/520

[58] Field of Search ..... 60/517, 520

[56] References Cited

U.S. PATENT DOCUMENTS 4,412,418 11/1983 Beale ..... 60/520

*Primary Examiner*—Allen M. Ostrager

*Attorney, Agent, or Firm*—Frank H. Foster

[57] ABSTRACT

The apparatus of the invention relates to a free piston Stirling engine that contains a power piston and a displacer piston which each reciprocate in a coaxial cylinder. At least one piston is hydrodynamically lubricated to avoid friction based wear by spinning the piston about its axis through the utilization of at least one magnetic article mounted onto one of the interfacing wall surfaces. The article magnetically interacts with a track made of magnetic material mounted on the opposing, interfacing surface so that during operation the interaction creates a torque which spins the piston about its axis and causes the desired lubrication to take place.

14 Claims, 3 Drawing Sheets

MAGNETIC DRIVEN HYDRODYNAMIC LUBRICATION SYSTEM FOR FREE PISTON STIRLING ENGINE

TECHNICAL FIELD

This invention relates to an apparatus and an accompanying method for the lubrication of a free piston Stirling engine which has a power piston and a displacer piston that each reciprocate in a cooperating, coaxial cylinder as the working gas flows around the reciprocating pistons during engine operation. The apparatus and method of the present invention are particularly useful for lubricating at least one of these pistons in a free piston Stirling engine.

BACKGROUND ART

U.S. Pat. No. 4,412,418, discloses the present inventor's earlier efforts to design an apparatus that is for effecting the lubrication of expansible chamber devices of the type which have a cylinder with a piston reciprocating therein and have fluid flowing in and out of the chamber. The invention described is particularly suitable for use in free piston Stirling engines and pumps. A torque force is applied to the piston, causing it to spin sufficiently so as to entrain and drag along its outer surface some of the fluid in the expansible chamber, so as to separate its outer surface from the wall of the cylinder. However, this torque applying structure is extremely different from the utilization of magnetic articles for effecting the aforementioned piston lubrication.

A major advantage of the free piston Stirling engine is that the working gas can be entirely sealed within the engine to prevent its contamination or loss by leakage. It is undesirable to lubricate the pistons of the free piston Stirling engine with additional lubricants, such as petroleum based oil and grease, because such lubricants vaporize into the working gas and reduce its efficiency.

Nonetheless, it is still extremely desireable to lubricate these engines for the purpose of extending the life of the engine and reducing its wear and maintenance.

It is therefore an object of the present invention to effect the hydrodynamic lubrication of the power piston in a free piston Stirling engine through use of the fluids which act upon, or are acted upon by the piston in the operation of the Stirling engine.

BRIEF DISCLOSURE OF INVENTION

In the present invention a free piston Stirling engine contains a power piston and a displacer piston which each reciprocate in a cooperating, coaxial cylinder. At least one piston is hydrodynamically lubricated so as to avoid undesired engine friction and wear between the interfacing surfaces of the piston and the cylinder by spinning the piston about its axis through the utilization of an improved apparatus for spinning the piston. This apparatus comprises at least one magnetic article which is mounted onto one of the interfacing wall surfaces, i.e., the piston outer surface or the surrounding cylinder wall surface. The apparatus also includes a track made of magnetic material, which is mounted around at least part of the other interfacing surface and is formed in the shape of a series of segments that are positioned in alternately inclined, opposite oblique directions around a central axis along at least part, and preferably all, of the surface.

During operation, the magnetic article and the magnetic material track when in close proximity during piston reciprocation apply an equal and opposite force upon each other so as to create a torque which will be applied to the piston. The torque causes the piston to spin at a sufficient angular velocity to entrain and drag along its outer surface some of the fluid, i.e., a torque is created which spins the reciprocating piston about its axis and thereby causes the desired lubrication of the interfacing surfaces.

Figure 1:
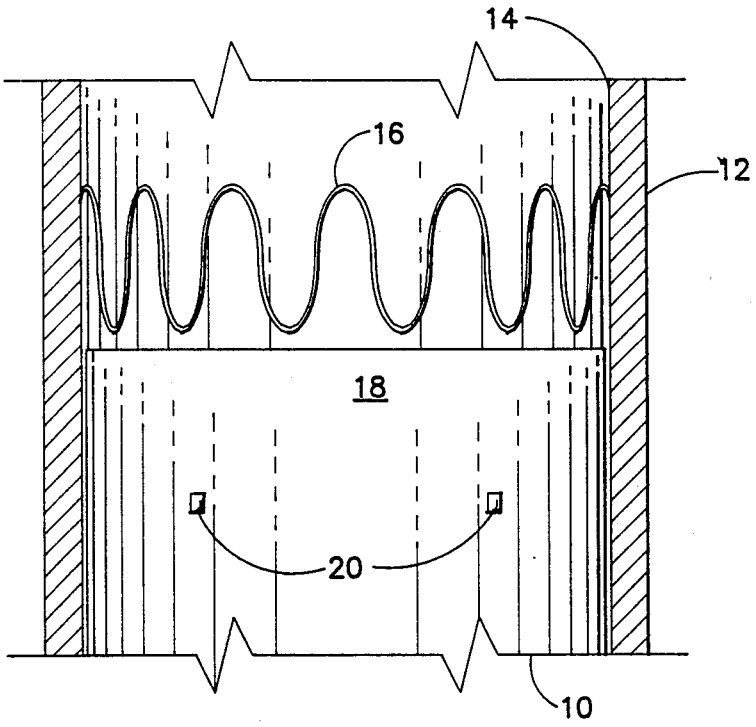
FIG. 1 discloses a diagrammatic view in axial cross section which illustrates a power piston that is utilized in a Stirling engine and features a plurality of magnetic articles mounted on the piston and a sinusoidal magnetic material track on the adjacent coaxial cylinder wall.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

FIG. 1 illustrates a cylinder of a free piston Stirling engine that contains a power piston 10 which reciprocates inside a single, cooperating, coaxial cylinder 12. In the preferred embodiment described, the cylinder inner wall surface 14 includes a magnetic material track 16, preferably shaped in the form of a sinusoidal curve about its inner circumference 14, but in the broadest embodiment need only comprise a series of segments in alternately inclined, oblique directions around the inner wall surface 14 of cylinder chamber 12.

Along the piston outer surface 18, a plurality of magnetic articles 20 are mounted in a manner which does not impede piston movement within the cylinder. For example, they may be positioned in cavities or bores into the piston wall, or the like. In the broadest embodiment, only a single magnetic article 20 is needed t magnetically correspond to each interfacing track 16, but it is preferred to mount a plurality of magnetic articles on the wall surface to correspond to each magnetic track. However, it is essential that the sum of the plurality of magnetic forces which are exerted by the magnetic articles against the magnetic material track 16 on interfacing surface 14 cancel, so that the reciprocating piston 10 movement within the cylinder 12 is unimpeded. This is accomplished by positioning the articles 20 around the piston outer surface 18 in a geometric arrangement so that the magnetic forces exerted by each article 20 against the interfacing cylinder wall surface substantially cancel each other in the radial direction.

The free piston Stirling engine containing the piston and cylinder described in FIG. 1 operates in the conventional manner, as is well known in the art. The alternate heating and cooling of the working gas fluid causes the gas to alternately expand and increase its pressure and contract and decrease its pressure. These alternate changes in pressure cause the power piston to reciprocate, and since the fundamental operation of the free piston Stirling engine is well described in the prior art no further description is necessary here.

In the embodiment illustrated in FIG. 1, before operation, the magnetic articles 20 may be initially spaced a distance from the magnetic material track 16, so the articles and track may not initially magnetically interact with each other. During initial piston reciprocation they will eventually intersect. The piston will then pivotably oscillate in a clockwise-counterclockwise reciprocating manner as the piston axially reciprocates along the control section of the magnetic track 16. When the amplitude of the reciprocating piston carrying the magnetic articles approximates the amplitude of the magnetic material track 16 the articles magnetically lock onto the track. Upon reaching this equilibrium, the piston 10 then begins to spin in one direction at a rate which is determined by the wavelength of the track. The magnetic articles essentially move along the path of the track thereafter, i.e., in a substantially sinusoidal movement.

Figure 2:
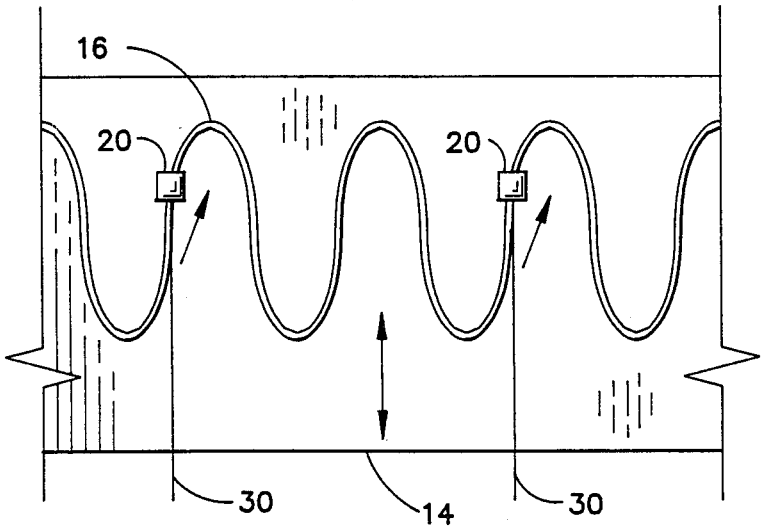
FIG. 2 discloses a laid out view of the cylinder chamber surface of FIG. 1, which also includes a power piston reciprocating within the coaxial cylinder.

FIG. 2 discloses a laid out view of the surface of the inner piston cylinder 14 of FIG. 1, clearly indicating that the magnetic material track 16 forms a substantially sinusoidal pattern along the inner cylinder wall surface 14. Additionally, in the embodiment shown two magnetic articles 20 are mounted on reciprocating piston 30, with the motion of the reciprocating piston upon reaching the desired equilibrium state being in the sinusoidal clockwise or counterclockwise direction along the surface of track 16.

The advantages of the magnetic lubrication system of the present invention are not limited only to lubrication of the power piston in the coaxial cylinder containing the free piston Stirling engines described, supra. The invention can also be utilized to lubricate the displacer piston during its reciprocating path. Furthermore, the lubrication system is applicable to free piston Stirling engines in which the displacer piston or the power piston reciprocate in different cylinders Also, the system is applicable to the broader range of expansible chamber devices which have a piston which both reciprocates and is free to rotate about its axis. For example, many such piston devices have a piston which is connected by an intermediate piston or connecting rod to a crankshaft. The addition of a suitable bearing on the piston rod in such a device will enable its piston to be free for rotation in addition to reciprocation. Thus the principles of the present invention, in the broadest embodiment, are applicable to other engines, pumps and motors of the expansible chamber, reciprocating free piston Stirling type.

The term "magnetic article" as used herein so defines a magnetic article which is capable of exerting a desired magnetic attraction or repulsion force upon another magnet or ferromagnetic material. The magnetic track which interacts with the magnetic article must be designed so that either the article or track is a magnet, while the other is either a magnet or made of a ferromagnetic material. Of course, the interfacing piston and cylinder walls cannot be fabricated from ferromagnetic materials.

The particular configuration of the magnetic article and the magnetic material track may be modified in a variety of ways. Several alternative preferred embodiments are further described in FIGS. 3–6.

Figure 3:
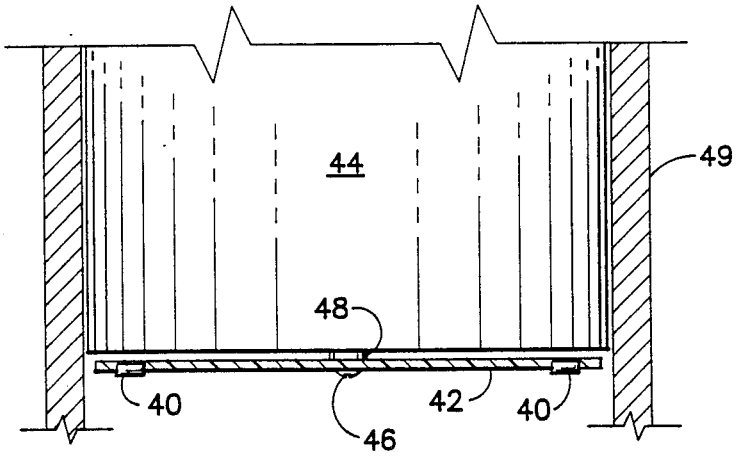
FIG. 3 discloses an embodiment similar to FIG. 1 in which the magnetic articles are mounted on the perimeter of a rotating disc which is connected to the piston through a friction clutch.

FIG. 3 discloses a modification of the embodiment set forth in FIG. 1, in which the magnetic articles 40 are mounted on a light wheel or disc 42 that is attached to piston 44 by a screw 46 and washer 48 to prevent friction slippage. The resulting embodiment, or friction clutch operates in a manner such that as piston 44 axially reciprocates in cylinder 49, the disc 42, having mounted thereon the magnetic articles 40, has a weight which is light enough to enable the disc to rapidly come into synchronization with the magnetic material track (not shown) on the interfacing cylinder wall, while the piston rotation slowly comes up to the speed of disc 42 by friction. At the time that piston 44 approaches the angular velocity of disc 42, the clutch locks the magnetic articles 40 and the track together, as the piston rotates with the disc, following the sinusoidal track in the previously described manner.

Figure 4:
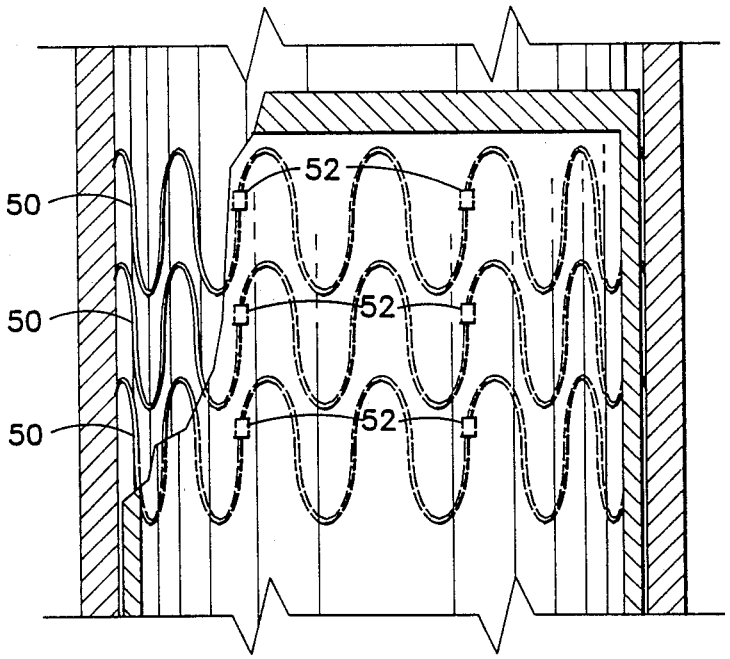
FIG. 4 discloses another embodiment wherein the cylinder wall possesses more than one sinusoidal magnetic material track and the interfacing piston surface has a plurality of corresponding magnetic articles for each track.

FIG. 4 discloses an embodiment which is substantially identical to that set forth in FIG. 1, except that a plurality of magnetic material tracks 50 and corresponding magnetic articles 52 for locking onto each track 50 are mounted on the walls of the two interfacing surfaces of the piston and the coaxial cylinder in a manner described, supra.

Figure 5:
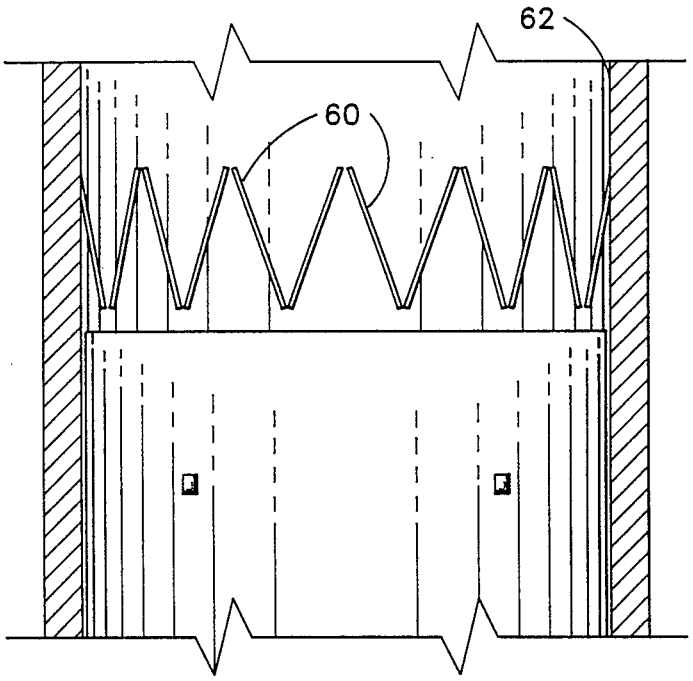
FIG. 5 discloses an embodiment in which the cylinder wall contains a magnetic material track in the form of alternating pairs of oblique line segments.

FIG. 5 discloses an embodiment of the invention, in which the magnetic track is formed by a series of segments 60 in alternatingly inclined, opposite oblique directions around a central axis along at least part of the particular interfacing surface 62 it is positioned thereon. However, it is preferred that the magnetic material track have a sinusoidal shape along the entire interfacing surface of the cylinder wall. Most preferably, the magnetic material track extends around the entire circumference of the interfacing surface.

Figure 6:
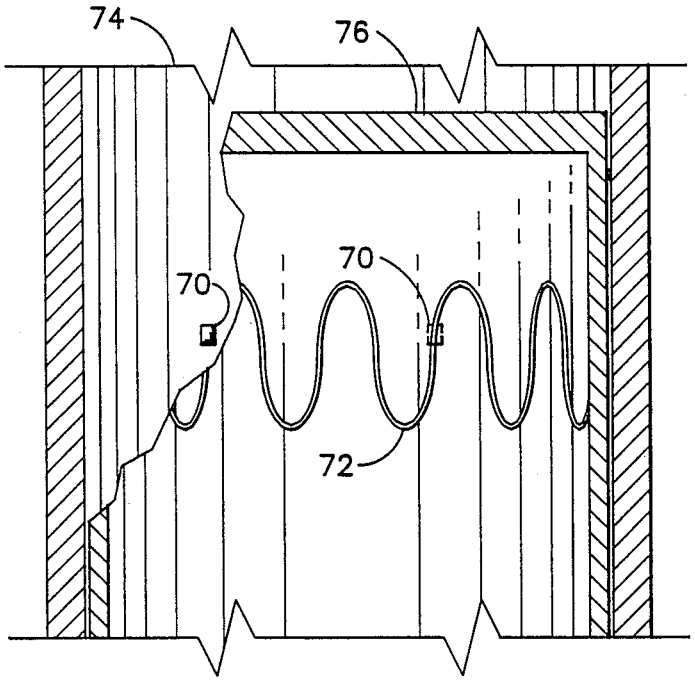
FIG. 6 discloses yet another embodiment in which the magnetic articles are mounted on the cylinder wall and the magnetic track is positioned along the piston surface.

FIG. 6 discloses an embodiment which is substantially similar to that of FIG. 1; however, the magnetic articles 70 and the magnetic material track 72 are now mounted on the interfacing surfaces of the coaxial cylinder 74 and reciprocating piston 76 respectively, thereby reversing their locations as set forth in FIGS. 1–5. The mode of operation is, however, essentially identical to that recited above.

In the most preferred embodiment, a sinusoidal curve is preferred for use as the magnetic material track, since this is the natural path along which the magnetic article will move when the reciprocating piston is moving at a constant amplitude and rotating at a constant speed within the cylinder. However, as mentioned above, other variations in the track geometry are within the scope of the invention.

The invention further relates to a method for lubricating the power piston of a free piston Stirling engine that reciprocates in a cooperating coaxial cylinder, with the piston being hydrodynamically lubricated between the interfacing surfaces of the piston and the cylinder wall by spinning the piston about its axis. The method comprises applying a torque force to the piston that causes the piston to spin sufficiently so as to entrain and drag along its outer interfacing surface a sufficient amount of the working fluid of the engine, so as to separate the piston's outer interfacing surface from the interfacing surface of the cylinder wall. In contrast to the system set forth in the U.S. Pat. No. 4,412,418, this movement is created by a torque which causes an equal and opposite force between at least one magnetic article which is mounted on one of the interfacing surfaces and the corresponding magnetic material track which is on the opposite interfacing surface, with the attraction occurring during piston reciprocation in the cylinder at the point when the magnetic article attains a sufficient proximity to the corresponding magnetic segment.

While certain preferred embodiments of the present invention have been disclosed in detail, it is to be understood that various modifications may be adopted without departing from the spirit of the invention or scope of the following claims.

I claim:

1. In a free piston Stirling engine having a power piston and a displacer piston in which each reciprocate in a cooperating, coaxial cylinder, at least one of the pistons being hydrodynamically lubricated between the interfacing surfaces of the piston and the cylinder by spinning the piston about its axis, the improved means for spinning the piston comprising:

(a) a first magnetic article mounted to one of the interfacing surfaces; and (b) a magnetic material track positioned to include a series of segments in alternately inclined, opposite oblique directions around a central axis along at least part of the other interfacing surface;

wherein the first magnetic article and the magnetic material track, when in sufficient proximity during reciprocation, apply equal and opposite forces upon each other to create a torque which spins the reciprocating piston about its axis.

2. Apparatus according to claim 1 wherein the at least first magnetic material has its series of segments connected in the form of a sinusoidal track around the central axis along the entire interfacing surface.

3. Apparatus according to claim 1 wherein there are at least two separate series of segments of magnetic material around the central axis; each series of segments positioned to apply equal and opposite forces upon its corresponding magnetic article to apply a torque to spin the reciprocating piston about its axis.

4. Apparatus according to claim 1 wherein the magnetic article is attracted to the magnetic material series of segments.

5. Apparatus according to claim 1 wherein the magnetic article is repelled by the magnetic material series of segments.

6. Apparatus according to claim 1 wherein a plurality of magnetic articles are mounted to one of the interfacing surfaces, each article magnetically effected by an even number of diametrically opposed series of magnetic material segments.

7. Apparatus according to any one of claims 1–6 wherein the magnetic article is mounted to a disc that is drivingly engaged to the piston by a friction clutch.

8. Apparatus according to claim or 3 wherein each magnetic material track applies equal and opposite forces to a single magnetic article.

9. Apparatus according to claim wherein the first magnetic article is mounted to the piston interfacing surface.

10. Apparatus according to claim 1 wherein the first magnetic article is mounted to the inner cylinder interfacing surface.

11. In a method for lubricating a power piston and a displacer piston of a free piston Stirling engine in which each reciprocate in a cooperating, coaxial cylinder, at least one of the pistons being hydrodynamically lubricated between the interfacing surfaces of the piston and the cylinder wall by spinning the piston about its axis, wherein the method comprises applying a torque force to the piston causing it to spin sufficiently to entrain and drag along its outer interfacing surface some of the working fluid of the engine so as to separate its outer interfacing surface from the interfacing surface of the cylinder wall, the improvement comprising creating the torque force by causing equal and opposite forces between at least a first magnetic article mounted to one of the interfacing surfaces and at least one magnetic material track positioned to include at least a series of alternately inclined segments in opposite oblique directions to a central axis around at least part of the cylinder wall, the attraction occurring during piston reciprocation in the cylinder when the magnetic article is in sufficient proximity to the nearest magnetic segment.

12. A method according to claim 11 wherein the magnetic force is a magnetic attracting force.

13. A method according to claim 11 wherein the magnetic force is a magnetic repulsion force.

14. A method according to claim 11 wherein the at least first magnetic material has its series of segments connected in the form of a substantially sinusoidal track around the central axis along the entire interfacing surface.

* * * * *